United States Patent [19]

Erwin

[11] 4,116,248

[45] Sep. 26, 1978

[54] APPARATUS FOR TEXTURIZING A MATERIAL

[75] Inventor: Wayne F. Erwin, Wooster, Ohio

[73] Assignee: Koppers Company, Inc., Pittsburgh, Pa.

[21] Appl. No.: 835,857

[22] Filed: Sep. 23, 1977

[51] Int. Cl.[2] ..... B27G 13/00

[52] U.S. Cl. ..... 144/2 R; 144/123; 144/326 R

[58] Field of Search ..... 30/371, 372; 144/2 R, 144/123, 208 J, 114 R, 162 R, 218, 321, 326 R; 83/788

[56] References Cited

U.S. PATENT DOCUMENTS

| | | | |
|---|---|---|---|
| 3,092,156 | 6/1963 | Hayden | 30/371 |
| 3,093,170 | 6/1963 | Thayer | 144/123 X |
| 3,299,922 | 1/1967 | Vonhof | 144/326 R |
| 3,495,638 | 2/1970 | Humphrey | 144/326 R |
| 3,561,509 | 2/1971 | Hayden | 144/123 |
| 3,756,295 | 9/1973 | Halop | 144/326 R |

*Primary Examiner*—Frank T. Yost

*Assistant Examiner*—W. D. Bray

*Attorney, Agent, or Firm*—Herbert J. Zeh, Jr.; Oscar B. Brumback

[57] ABSTRACT

There is disclosed an apparatus for providing various decorative or textured surfaces on a material such as wood. Texturizing on a material surface is accomplished using a portable chain saw angled with respect to the material to be texturized with its cutting depth restrained. The apparatus includes a portable chain saw which has attached to it a pair of rollers, an edge alignment wheel and a pair of support bars. The support bars stabilize the chain saw blade, assist in angling the chain saw and engage the cutting depth. The rollers, assisted by the support bar, maintain the chain saw in angled orientation with respect to the material to be surfaced as the chain saw is passed over the material. The edge alignment wheel maintains proper alignment between the chain saw and the material to be surfaced. The apparatus is portable in design, providing a versatile means of texturizing large structural materials, especially wooden structural elements.

3 Claims, 4 Drawing Figures

APPARATUS FOR TEXTURIZING A MATERIAL

BACKGROUND OF THE INVENTION

This invention relates to apparatus for producing a textured surface on a work piece. More particularly, this invention relates to such texturizing apparatus employing cutters mounted on an endless chain or belt.

Recently, demand for texturized surface materials, mainly wood products, has experienced a rapid growth which is most evident in the wood panel area. Texturized structural wood elements has also experienced growing demand. The design of prior art devices which employ an endless chain or belt with cutting teeth mounted on the chain for texturizing materials have restricted their application to essentially panel or board type materials. The devices are ill suited for texturizing large structural elements which often take irregular shapes.

The prior art devices are generally stationary. When large structural elements are made or formed at a location distant from that of the stationary texturizing device, an expense can be incurred in transporting the structural element to the location of the texturizing device.

This invention provides a means of texturizing material which is both inexpensive and versatile and can accommodate both board and structural type elements. The invention is particularly suitable for testurizing irregularly shaped materials.

SUMMARY OF THE INVENTION

The invention herein disclosed and described is an apparatus for texturizing materials. The apparatus utilizes a portable chain saw with a pair of rollers, an edge alignment wheel and a pair of support bars. The rollers and support bars are adjustably mounted to each side of the chain saw in cooperative alignment to maintain the chain saw in angled orientation to the work piece thereby facilitating lateral motion along the work piece. The support bars gauge the cutting depth. The edge alignment wheel retards riding of the chain saw across the work piece and assists in assuring a uniform textured surface.

DETAILED DESCRIPTION

Figure 3:
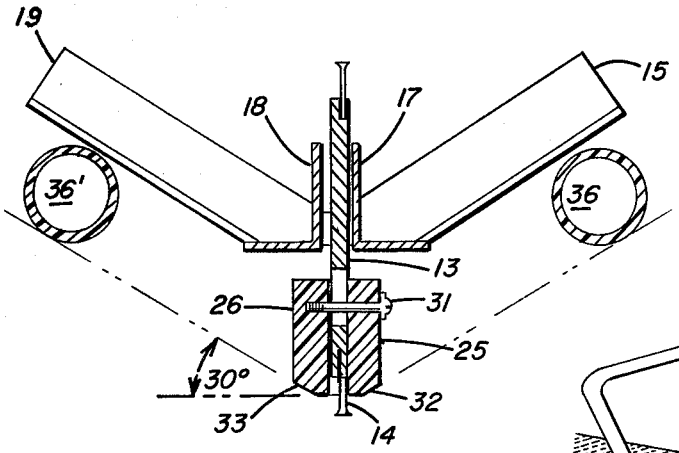
FIG. 3 shows a frontal view of the apparatus emphasizing the alignment of the roller with the support bar.

The apparatus described utilizes a conventional portable chain saw 11 which may be air, electric or gasoline powered. For optimum versatility the chain saw 11 should have detachable and interchangeable chain bar 13 and cutting chain 14 (FIG. 3). By changing the chain bar and attaching a corresponding length cutting chain, different sized surface areas can be accommodated. Different textures can be derived by changing cutting chains, each cutting chain carrying cutters sized differently from other cutting chains.

Figure 1:
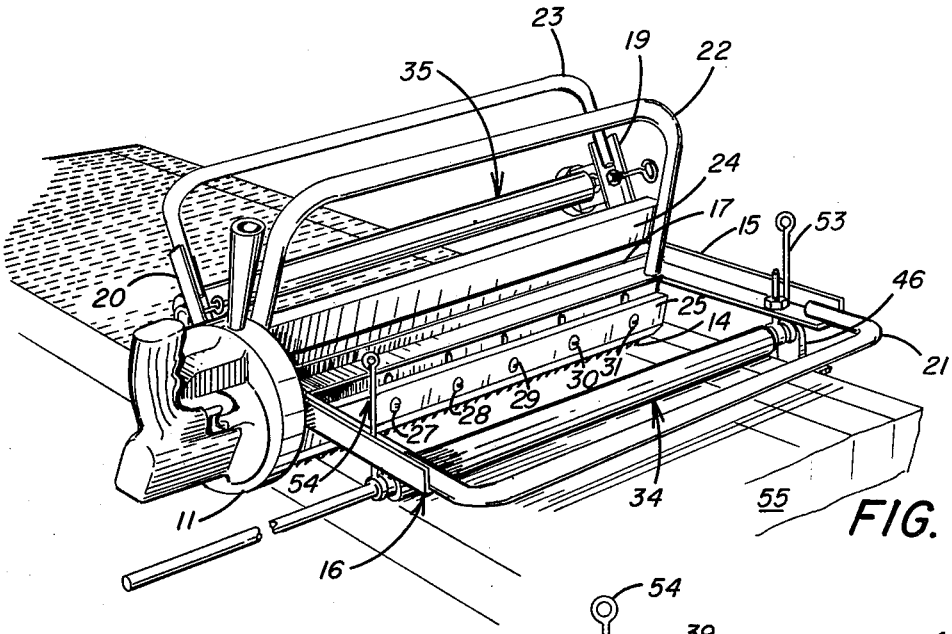
FIG. 1 shows a perspective of the apparatus on a work piece.

Fixably mounted by conventional means such as welding to the chain bar 13 are L-shaped mounting members 15, 16, 17, 18, 19 and 20 (FIGS. 1 and 3). Mounting members 17 and 18 are mounted longitudinally along the chain bar 13 with one mounting member on each side of the chain bar. Mounted to each end of the chain bar and to each side extending perpendicularly from the side of the chain bar is a mounting member (either 15, 16, 19, or 20), each having a slight angle of elevation with respect to the chain bar cross sectional. Fixably mounted by conventional means to the mounting members are handles 21, 22 and 23.

A U-shaped chain cover 24 is desirable to facilitate operator's safety as shown in FIG. 1. The chain cover is mounted to the chain bar 13 by welding or any other conventional means.

As depicted in FIGS. 1 and 3, the chain bar has a plurality of generally rectangular shaped holes. Bar supports 25 and 26 are adjustably mounted to the chain bar by passing screws 27, 28, 29, 30 and 31 through the bar support 25, chain bar 13 and lodging the screws in bar support 26. The primary function of the bar supports is to restrain the cutting depth. The bar supports 25 and 26 have a 30° beveled surface 32 and 33 to facilitate angling of the apparatus with respect to the work piece 55.

Figure 2:
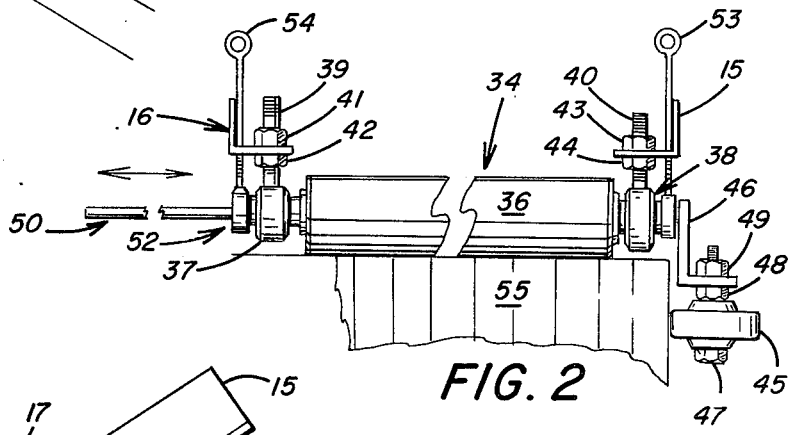
FIG. 2 shows a frontal view of the angled support assembly.

Angling of the apparatus facilitates lateral motion across a work piece and is accomplished through the use of an angle support assembly. The angle support assemblies 34 and 35, shown in FIG. 1, are mounted to mounting members 15, 16 and 19, 20, respectively. Support assembly 34 depicted in FIG. 2 will be described with the understanding that it is identical to assembly 35 which is mounted to the opposing side of the chain bar 13. The angle support assembly 34 employs a hollow roller 36 rotably mounted in members 37 and 38. Members 37 and 38 have threaded rod extensions 39 and 40 which pass through mounting members 15 and 16 and are adjustably fixed using hex nuts 41, 42, 43 and 44. An edge alignment wheel 45, which is part of the angle support assembly, is mounted to member 46 by passing a bolt 47 through the alignment wheel and securing the bolt using hex nuts 48 and 49. A shaft 50 is welded to member 46 and is passed through a shaft collar 51, the angle support assembly 34 and a second shaft collar 52. The shaft collars 51 and 52 are affixed to members 38 and 37, respectively, by conventional means such as welding. Eye bolts 53 and 54 pass through mounting members 15 and 16 and thread into shaft collars 51 and 52, respectively, such that force is exerted on shaft 50 in order to refrain the shaft from moving.

In operation, the operator adjusts the bar support 25 to achieve the desired cutting depth. The bar support is adjusted by loosening screws 27 through 31, raising or lowering the bar supports and tightening the screws. The angle support assembly is adjusted by turning the hex nuts 41, 42, 43 and 44 such that roller 36 is set at a position coplanar with the beveled surface 32 of the bar support 25, as illustrated in FIG. 3. The apparatus is placed transversely across the work piece 55 and will assume a 30° recline relative to the work piece when resting on the angle support assembly 34. The edge alignment wheel is adjusted such that it is in contact with the side of the work piece by loosening the eye bolts 54 and 53, and sliding the edge alignment wheel to the proper position and tightening the eye bolts. The portable chain saw 11 is then activated and pulled along the surface of the work piece in the direction indicated in FIG. 1. If the work piece is of a panel construction, the operator, after making a pass, deactivates the portable chain saw. He then moves the apparatus across the work piece and adjusts the apparatus as previously described, the adjustments being made to the duplicate angle support system 35. The operator then tilts the portable chain saw in the opposing direction and activates.

Figure 4:
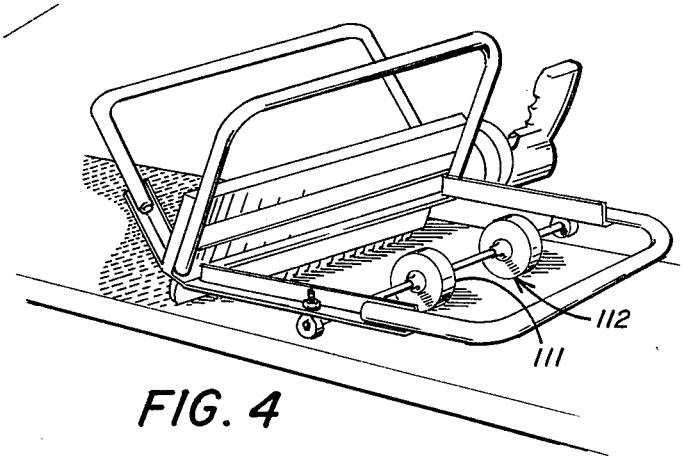
FIG. 4 is a perspective of an alternative embodiment.

FIG. 4 shows an alternative embodiment of the apparatus utilizing wheels 111 and 112 instead of roller 36.

I claim:

1. A portable surface texturizing apparatus which comprises:

(a) a portable chain saw having a saw chain bar carrying a rotable saw chain with cutters affixed thereto;

(b) a plurality of mounting members fixably mounted to the chain bar of said portable saw chain;

(c) a plurality of handles fixably mounted to said mounting members;

(d) a plurality of bar supports adjustably mounted along the chain bar, said bar supports having a beveled side extending longitudinally along the chain bar such that the beveled side will contact the surface of a work piece thereby to restrain the depth of cut;

(e) means for guiding said portable chain saw along the material to be surfaced; and (f) angle support means for providing support for said portable chain saw and maintaining said portable chain saw at the proper angle.

2. A portable surface texturizing apparatus as claimed in claim 1 where the angle support means comprises a plurality of rollers rotatably mounted to said mounting members.

3. A portable surface texturizing apparatus as claimed in claim 1 wherein the angle support means comprises a plurality of wheels rotatably mounted to said mounting member.

* * * * *